US007762188B2

(12) United States Patent
Iftime et al.

(10) Patent No.: US 7,762,188 B2
(45) Date of Patent: Jul. 27, 2010

(54) REIMAGEABLE PRINTING MEMBER

(75) Inventors: Gabriel Iftime, Mississauga (CA); Paul F. Smith, Oakville (CA); Peter M. Kazmaier, Mississauga (CA); Hadi K. Mahabadi, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 911 days.

(21) Appl. No.: 11/239,212

(22) Filed: Sep. 30, 2005

(65) Prior Publication Data

US 2007/0077515 A1 Apr. 5, 2007

(51) Int. Cl.
*B41N 1/00* (2006.01)

(52) U.S. Cl. ..... 101/478; 101/368; 101/395; 101/401.1; 101/487; 101/488; 101/401

(58) Field of Classification Search ..... None
See application file for complete search history.

(56) References Cited

U.S. PATENT DOCUMENTS 3,663,650 A 5/1972 Juliano
3,878,263 A 4/1975 Martin
3,994,988 A 11/1976 Laurin
5,233,921 A * 8/1993 John ..... 101/478
6,092,465 A * 7/2000 Agronin ..... 101/478
6,234,079 B1 * 5/2001 Chertkow ..... 101/395
6,696,221 B1 2/2004 McLean et al.
7,563,388 B2 * 7/2009 Mather et al. ..... 252/299.01

FOREIGN PATENT DOCUMENTS

JP A-11-258785 9/1999
WO WO 98/53370 A1 11/1998

* cited by examiner

*Primary Examiner*—Judy Nguyen
*Assistant Examiner*—Joshua D. Zimmerman
(74) *Attorney, Agent, or Firm*—Oliff & Berridge, PLC

(57) ABSTRACT

A reimageable printing member such as for use in flexography, includes a layer having a multiplicity of holes, wherein the holes include therein a dimension change material and a printing material upon the dimension change material. Thus, the holes house vertically expandable units, the top portion of which is capable of protruding out of an opening of the hole at a top surface of the layer. Each of the holes may be individually addressed to provide a stimulus that initiates a change in dimension in the dimension change material. In this manner, selected ones of the units may be made to print a corresponding portion of an image on an image receiving substrate brought into contact with the printing member.

22 Claims, 2 Drawing Sheets

REIMAGEABLE PRINTING MEMBER

CROSS-REFERENCE TO RELATED APPLICATION

Disclosed in commonly assigned U.S. patent application Ser. No. 11/239,072, filed on even date herewith and incorporated herein by reference in its entirety, is a reimageable printing member comprising a layer having a multiplicity of channels therein, the layer having an open side to which the multiplicity of channels are open, and wherein the reimageable printing member further includes a field generator comprised of an electrode and/or a magnetic field generator, the field generator associated with the multiplicity of channels and generating a field, and wherein the multiplicity of channels are individually addressable by the field generator.

BACKGROUND

This disclosure relates to a reimageable printing member, for example a reimageable printing plate such as a flexographic printing plate, and a method of forming images with such reimageable printing member.

The flexographic printing market is significant. Current examples of printing done by the flexography process include printing decorated toilet tissue, bags, corrugated board and other materials such as foil, cellophane, polyethylene and other plastic films.

In flexography, printing is done by using plates that contain the image to be transferred onto a substrate in the form of raised images upon the plate surface. Specifically, the flexographic plate surface contains a permanently raised image, i.e., a raised reverse image of the image to be formed on the substrate, usable for printing only a single same image on substrates. When a new or different image is needed, a new plate is fabricated and the previously used plate is stored or disposed. High cost associated with plate fabrication, as well as with storage of a large number of plates, requires flexographic printing jobs to be of the order of millions of identical prints per plate in order for the process to be cost effective.

REFERENCES

WO 98/53370 describes a printing plate including a support assembly and a relief imaged surface formed directly on the surface of the support assembly by digital photopolymerization. The support assembly may be in the form of a cylindrical sleeve or a flat polymeric base. The printing plate is formed by providing a liquid photopolymer on the surface of the support assembly and irradiating the polymer with a source of actinic to form the relief image. The printing plate is reimageable and may be used in flexographic printing processes as well as other printing applications.

JP 11-258785 describes a plate including a cis-trans photoisomerization azobenzene layer 35 formed on a supporting body 34. Layer 35 is contracted as a whole by being uniformly irradiated with ultraviolet rays first. Next, it is returned to an original trans state by being irradiated with visible light 36 being stimulation inputted based on image information. Therefore, only the part 37 thereof irradiated with the light 36 is swollen. Surface recessed and projection patterns obtained based on the image information are formed at the surface of the layer 35. At a next step, the uniformly formed thin layer of the color material 38 is closely brought into contact with a color grain supply supporting body 39 and the grains 38 are attached to the swollen part 37 by attaching force such as adhesive strength to form an image area. Then, the color grains in the image area are transferred to a medium to be recorded 40.

SUMMARY

There is a need for a printing member in which the image on the member can be changed without having to dispose of the member.

Accordingly, described herein is a reimageable printing member, for example for use in flexography, and a method of forming images using such reimageable printing member.

In embodiments, described is a reimageable printing member comprising a multiplicity of vertically expandable units, wherein each of the vertically expandable units includes a dimension change material, and wherein the multiplicity of vertically expandable units are individually addressable by a stimulus that initiates a change in dimension in the material. Each unit may further include a printing portion over the dimension change material, and each unit may be individually addressed by a stimulating portion associated with the unit that provides the stimulus.

In further embodiments, described is a reimageable printing member comprising a layer having a multiplicity of holes therein, wherein the holes include therein a dimension change material and a printing portion over the dimension change material, the printing portion being capable of protruding out of an opening of the hole at a top surface of the layer, and wherein each of the holes further has associated therewith a stimulating portion that provides a stimulus that initiates a change in dimension in the material.

In embodiments, also described is a method of forming an image with a reimageable printing member comprising a layer having a multiplicity of holes therein, wherein the holes include a dimension change material and a printing portion over the dimension change material, the printing portion being capable of protruding out of an opening of the hole at a top surface of the layer, and wherein each of the holes further has associated therewith a stimulating portion that provides a stimulus that initiates a change in dimension in the material, the method comprising providing the stimulus with the stimulating portion that is associated with selected ones of the multiplicity of holes that correspond to portions of an image to be formed by the reimageable printing member, wherein providing the stimulus achieves a dimension change in the material, whereby the printing portion is moved vertically to protrude out of the hole and into a printing capable position on an imaging surface of the layer, providing marking material to the imaging surface of the reimageable printing member, and contacting the imaging surface of the reimageable printing member with an image receiving substrate to form the image on a surface of the image receiving substrate.

By being reimageable, the printing member may reduce the number of members that need to be fabricated. Such a reimageable member may also reduce the total printing time because there is no more need to replace a used member with a new one before continuing printing. The reimageable member may also enable development of a wide body of direct marking engines for printing documents.

EMBODIMENTS

Figure 1:
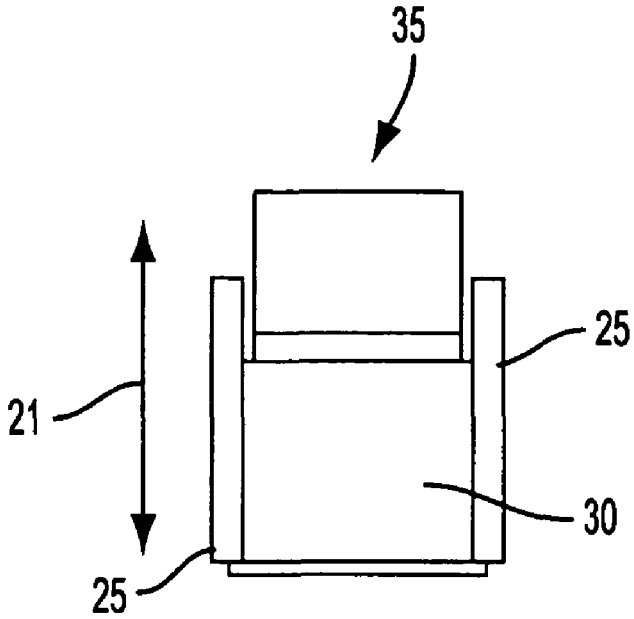
FIG. 1 illustrates an example layer of the reimageable printing member having a multiplicity of holes therein.

The printing member described herein is reimageable. In embodiments, reimageable refers to reuse of the same printing member in forming two or more different images. For example, in embodiments reimageable indicates that the member is not restricted to use in forming only a single image until discarded, and is capable of being used in forming any number of different images during the member's useful life. The member may thus be reimageable in not being restricted to use in forming only a single image. As such, the same printing member can be used to form multiple different images.

The reimageable printing member is, for example, a reimageable printing plate such as a reimageable flexographic printing plate.

The reimageable printing member in embodiments includes a layer having a multiplicity of holes such as channels or openings. Multiple layers may be used. The holes are open to at least an imaging surface, or side, of the layer, which is the side that will face an image receiving substrate when forming an image on the image receiving substrate using the printing member. In use, marking material such as toner and/or ink is applied to this imaging surface of the printing member, and an image receiving substrate is contacted with the imaging surface of the printing member to transfer the image onto the image receiving substrate.

Each of the holes may be described as corresponding to a pixel of an image to be formed by the printing member. While any size and shape of holes may be used, and any spacing between holes may be used, in embodiments the holes have an average width or diameter of, for example, from about 1 μm to about 200 μm, such as from about 1 μm to about 100 μm or from about 1 μm to about 50 μm or to about 10 μm. In addition, as each hole location represents a separate location where marking material may be supplied to the surface of an image receiving substrate, higher quality, higher resolution, denser images can be formed the more closely spaced each of the individual holes is from each other. In this regard, the holes may be made to have an average spacing distance between adjacent holes of from, for example, about 0.01 μm to about 1,000 μm, such as from about 0.1 μm to about 1,000 μm or from about 0.1 μm to about 100 μm. Any suitable technique may be used to form the holes in the layer. For higher resolution printing members having more closely spaced holes, known photolithographic methods may be used to form the holes within the layer. The total number of holes in the sheet may be from about 100 to about 100,000,000 such as from about 10,000 to about 75,000,000. For example, when the reimageable printing member has a size appropriate for printing letter size paper (for example, 8½ by 11 paper), a number of holes in the reimageable printing member may be from about 50,000 to about 50,000,000.

In embodiments, the holes may extend all the way through the thickness of the layer so as to be through holes. In alternative embodiments, the holes may be made to extend to a depth within the layer without extending all the way through the layer. In embodiments, either the holes do not extend all the way through the layer or the layer at the side of the member opposite the imaging side is made to include a base that closes the holes on such side. The holes are to remain open on the imaging side of the member. In this manner, the holes can house vertically extendable units such as pistons or micropistons, discussed further below.

In embodiments, the thickness of the layer may vary and, for example, the thickness may be as thin as, for example, about 2 μm or as thick as, for example, about 4 cm. The thickness of the layer may thus be from about 300 microns to about 1 cm.

In embodiments, the member includes a multiplicity of vertically extendible units such as pistons or micropistons. These units may be housed within the multiplicity of holes discussed above, and thus the total number of units may be the same as the total number of holes as described above. A vertically extendable unit in embodiments refers to a unit capable of reversibly expanding or extending in a vertical direction, which direction is substantially perpendicular to the plane of the imaging surface of the printing member. The vertically extendible unit thus is capable of expanding and contracting in the hole so as to extend or retract with respect to the imaging surface of the layer.

The holes, or the vertically extendible units, contain therein at least a dimension change material. A dimension change material in embodiments refers to any material that can be made to change dimension, for example by expansion and/or contraction, in response to an applied stimulus such as heat, light, electricity, magnetism and the like. In embodiments, the dimension change material responds to the stimulus by increasing in dimension, and reverts to substantially the original dimension upon removal of the stimulus. The dimension change material in embodiments is a material that can increase in volume by from about 10% to about 250%, such as from about 10% to about 150%, in response to an applied stimulus.

If the dimension change material is a solid or gel-like material, it may be shaped to be placed into a hole of the layer and/or into the vertically expandable unit to be housed in the hole. If the material is less viscous and/or more fluid, it may be desirable to encapsulate the liquid material in a solid, expandable casing such as a plastic with elastic properties. The encapsulated dimension change material may then be placed within the holes and/or units. However, so long as the dimension change material is sealed within a chamber of the hole and/or vertically extendable unit, any suitable technique for housing the material within the hole and/or unit may be used.

As the dimension change material, any material that responds to application of an external stimulus with a dimension change may be used. As the external stimulus, use may be made of, for example, an electric field, a magnetic field, light, heat, combinations thereof and the like. There are several known types of materials capable of changing dimension under appropriate stimuli, and all of them are suitable for use as the dimension change material herein. Several example materials suitable for use herein are set forth below for illustration.

Examples of materials that change dimension at least in response to application of an electric field as the stimulus include, for example, electro-active polymers that convert electrical energy into mechanical energy. Suitable examples include electrically actuated dielectric silicone, fluoroelastomers and acrylic elastomers. Polymers comprising silicone and acrylic moieties are also suitable. Examples of commercially available silicone elastomers include NuSil CF19-2186 from Nusil Technology and HS3 from Dow Corning. Examples of acrylic elastomers include the 4900 VHB acrylic series from 3M Corp., for example VHB 4910. An example of a suitable commercial fluoroelastomer is Dow Corning 730. Blends made of two or more elastomers are also suitable. For example, a suitable blend is made of a silicone elastomer and an acrylic elastomer. Copolymers containing silicone, acrylic and halogenated elastomer structural units are also suitable. Specific examples include copolymers consisting of any combination of two or more structural units that are the result of polymerization of acrylic monomers like acrylic acid, acrylonitrile, 2-ethylhexyl acrylate, decyl acrylate, dodecyl acrylate, hexyl acrylate, isononyl acrylate, isooctyl methacrylate and 2-ethylhexyl methacrylate. Actuated strains of 117% were demonstrated with silicone elastomers and up to 215% with acrylic elastomers using prestrained films (R. Pelrine et al., Science, 2000, 836 and Pelrine et al., Proceedings SPIE, 2001 4329, pp. 335-349).

Another class of suitable materials responsive to a electric field stimulus are thermotropic liquid crystalline elastomers. These may be prepared by crosslinking thermotropic liquid crystalline polymers. The liquid crystalline elastomers show combined properties of a self-organized liquid crystal and a network polymer with rubber like elasticity. The dimension change material is then made from a side-chain type mesogenic polymer mixed with a miscible low molecular weight liquid crystal. The polymer is made by polymerization of a mesogenic monomer. The mesogenic units on the polymer structure provide liquid crystalline behavior to the polymer. The mesogenic units are known to those skilled in the art. They may include, for example, ciano-biphenyl structures. The polymerizable moiety of the monomer may be, for example, acrylate or ethylene. The crosslinker can be a polyacrylate monomer, having two or more acrylate groups. Suitable low molecular liquid crystals include, for example, 4-cyano-4'-alkyloxy-biphenyl compounds. A specific example consists of 4-cyano-4'-hexyl-acrylate as a monomer, 1,6-hexyldiacrylate as a crossliker and 4-cyano-4'-hexyloxy-biphenyl as a low molecular weight liquid crystal. See, for example, R. Kishi et al. Chemistry Lett., 1994, pp. 2257; R. Kishi, Ch. 9, in Polymer Sensors and Actuators; and Y. Osada et al., Eds., Springer-Verlag, 2000.

Carbon nanotube actuators are also suitable for use as a dimension change material responsive to an electric filed stimulus. See, for example, R. H. Baughman et al., Science, 284, 1999, pp. 1340.

Polymer gels represent another class of suitable dimension change material that is responsive to an electric field stimulus. Polymer gels may comprise a cross-linked network and a fluid filling the interstitial space of the network. The fluid permeates the medium as a continuous phase. When the fluid is water, the material is called a hydrogel. The material swells and shrinks reversibly in the presence of an electric field. Suitable examples of hydrogels responding to an electrical field include but are not limited to polyacrylamide gels prepared by free radical polymerization of acrylamide in the presence of a cross-linking constituent, for example N,N'-methylenebisacrylamide. Collapsing of 200-fold in volume is obtained when an electric field is applied (T. Tanaka et al., Science, v. 216, 1982, pp. 467).

Other example electric field responsive materials include a cross-linked poly(2-acrylamido-2-methyl propane) sulphonic acid (Y. Osada et al., Nature, 1992, pp. 242) and a cross-linked sodium salt of poly(acrylic acid) in water (R. Kishi et al., J. Chem. Soc. Faraday Trans. 1, 1989, pp. 655).

Examples of materials that change dimension at least in response to application of light such as visible or UV light as the stimulus include, for example, polymer films mixed with low molecular weight photochromic compounds. Suitable examples include nylon mixed with carotene or with cyanostilbene, as well as polystyrene mixed with spirobenzopyran (H. S. Blair et al., Polymer, 1980, 1475; H. S. Blair et al., Polymer, 1982, 779). A covalent bond of the photochromic compound to the polymer may achieve a material capable of producing a larger volume change in response to light. Additional suitable systems include polyamide and polyamide with backbone azobenzene groups, polyquinoline with backbone stilbene groups, polytetrahydrofuran with backbone viologen groups, polyalkylacrylates with azobenzene photochromic groups, and the like.

Polymer gels incorporating photochromic molecules may also undergo photostimulated dimension change. Suitable examples include water swollen poly(2-hydroxyethyl methacrylate) crosslinked with ethylene glycol dimethacrylate containing a small amount of photochromic chrysophenin G, which contracts upon irradiation. A similar behavior is known for cross-linked poly(methacrylic acid) in the presence of 4-phenyl-azophenyl-trimethylammonium ions. Polyacrylamide gels containing triphenylmethane leucocyanide are also suitable materials that exhibit reversible deformations of more than 100%. Discontinuous volume phase transitions may also be achieved with some poly(N-isopropylacrylamide) gels having triphenylmethane leucocyanide groups.

Polymers containing photoresponsive moieties like cinnamic groups or cinnamylidene acetic acid are also suitable. These materials undergo photoreversible [2+2] photoadditions when exposed to alternating wavelengths. The photoresponsive polymer may be stretched and/or fixed by irradiation with UV light of a particular wavelength, and the original shape recovered by irradiation with a different wavelength light that which produces the reverse photochromic reaction. The advantage of this approach is that it uses a solid state dimension change material. Specific examples include cinnamic acid grafted onto a polymer network made of a polymer and a crosslinker. Specific examples of suitable polymers include an alkyl acrylate such as n-butylacrylate, hydroxyethyl methacrylate or ethyleneglycol-1-acrylate-2-cinnamic acid. The crosslinker may be poly(propylene glycol)-dimethacrylate of various molecular weights. Still another approach is to include the cinnamic moiety into the polymer network by covalent bonds at the moment when the network is built. In this case, the photochromic molecule may contain acrylate or methacrylate groups capable of photocrosslinking into the polymer network. A suitable example is star-poly (ethylene glycol) containing cinnamylidene acetic acid groups (A. Lendlein et al., Nature, 2005, pp. 879).

A review of additional classes of compounds capable of changing dimension with light is set forth in M. Irie, Appl. Photochromic Polymers, 1992, page 174, incorporated herein by reference. Any of these materials may also be used as the dimension change material responsive to light.

Examples of materials that change dimension at least in response to application of heat as the stimulus include, for example, hydrogels as discussed above, for example including copolymers of N-isopropylacrylamide and acrylic acid in protic solvents (J. of Intelligent Materials Systems and Structures, 2000, 541), which respond not only to electrical field but also to heat by changing dimension. Additional examples of materials that change dimension is response to application of heat as the stimulus include, but are not limited to, grafted N-isopropylacrylamide on ethylene-vinyl alcohol polymers or polyethylene films in water, which swell/contract up 60% of the original volume when heating at 50° C. (H. Kubota et al., J. Appl. Polym. Sci., 1994, 925); crosslinked copolymers containing stearyl acrylate and methyl acrylate in water as solvent (Macromol. Rapid Commun., 1996, 539); and copolymers made from hydroxyethylacrylate and hydroxypropylacrylate in various ratios in water as the solvent that show contraction capabilities of up to 100% when heated (A. Safrani, Radiation Physics and Chemistry, 1999, pp. 121).

In embodiments, the dimension change material that is responsive to heat as the stimuli may expand and/or contract from at least about 10% of an original volume up to about 250% of the original volume or more, for example from about 50% to about 150% of the original volume of material.

Examples of materials that change dimension when subjected to a magnetic field include, for example, lyotropic liquid crystals. Lyotropic liquid crystals are a type of gel forming polymer that exhibits liquid crystal behavior if mixed with a solvent. Suitable dimension change lyotropic liquid crystal materials include poly(y-benzyl L-glutamate) having cholesteric liquid crystalline order in appropriate solvents such as dioxane, chloroform or methylene chloride and the like or mixtures of these solvents with other solvents such as methanol, ethanol and the like. Polyarylamides such as poly (p-phenyleterephthalamide (KEVLAR) and poly(p-benzamide) that form lyotropic liquid crystals in hydrogen bonding solvents may also be used.

The dimension change material may also be a material that responds to stimulus with an electrochemically based dimension change. In such materials, application of at least an electric field causes a chemical change in the material that results in the desired dimension change. For example, mention may be made of conjugated polymers that change dimension due to an oxidation-reduction reaction, where application of an electric field causes a chemical change in the material which is associated with ion insertion and extraction, which results in the desired dimension change. Examples of materials that change dimension electrochemically include, for example, conductive polymers with a solid electrolyte and ionic polymer-metal composites, for example, polypyrrole doped with dodecylbenzenesulfonate ions such as NaDBS, which swells anisotropically in the direction perpendicular to an applied electric field by about 10-20% (Material Research Society, 2004, vol. 782, pp. 101-107; E. W. H. Jager et al., Adv. Mater., 2001, pp. 76 and Y. Berdichevsky et al., Mat. Res. Symp. Proc. V. 782, 2004, pp. 101-107). Doped polypyrrole films also show a deformation when a voltage is applied thereto (K. Yamada et al., Jpn. J. Appl. Phys. 1998, pp. 5798). Other suitable redox active conjugated polymers include, for example, polyanilines and polythiophenes. Also suitable are polyferrocenyldimethylsilanes (M. Peter et al., Langmuir, 2004, pp. 891).

A review on ionic polymer-metal composites can be found in M. Shahinpoor et al., Smart Mater. Struct., 1998, R15, and any of these materials may be used herein as the dimension change material.

Accordingly, the dimension change material may respond to applied stimuli such as electric field, magnetic field, light, heat, combinations thereof and the like. As discussed above, the same dimension change material may respond to more than one type of stimuli, and thus the above examples are not mutually exclusive to the described stimulus.

In order to provide the stimulus to the dimension change material in the hole and/or unit, each hole and/or unit may have associated therewith a stimulating portion that applies the stimulus to the dimension change material therein. Depending on the dimension change material selected and the stimulus to which the dimension change material responds, the stimulating portion may comprise an electrode for applying an electric field, a light emitter for providing light stimulus such as visible or UV light, a heater or heating unit for providing heat stimulus, combinations thereof and the like. The stimulating portion may be made to be located at an outside portion of the hole. For example, the stimulating portion may be at the outside edges around the hole, may be beneath the hole, and the like. The stimulating portion may also comprise the outer portions of the vertically extendable unit. In other words, the stimulating portion may comprise a part of the layer in and/or around each hole, may be external to the layer but in association with the layer so as to be individually addressable with respect to each hole/unit, may be a part of each unit, and the like. In embodiments, regardless of the association between the stimulating portion and the dimension change material, each hole/unit is separately addressable by the externally applied stimulus for the sake of controlling the design of the image to be printed by the printing member, as will be explained in more detail below.

As the material for the layer including the multiplicity of holes, in embodiments the material does not substantially interfere with application of a stimulus that causes a dimension change in the dimension change material. For example, if the dimension change material changes dimension in response to application of an electric field, the material of the layer may be non-conductive so as to not interfere with application of the electric field. In embodiments, the layer is comprised of a polymer or plastic material, which may be any polymer or plastic material. Suitable materials include, for example, polycarbonates, polystyrenes, polysulfones, polyethersulfones, polyarylsulfones, polyarylethers, polyolefins, polyacrylates, polyvinyl derivatives, cellulose derivatives, polyurethanes, polyamides, polyimides, polyesters, silicone resins, and epoxy resins and the like. Copolymer materials such as polystyrene-acrylonitrile, polyethylene-acrylate, vinylidenechloride-vinylchloride, vinylacetate-vinylidene chloride, and styrene-alkyd resins may also be used. The copolymers may be block, random, or alternating copolymers.

Examples of polycarbonates include, for example, poly (bisphenol-A-carbonates) and polyethercarbonates obtained from the condensation of N,N'-diphenyl-N,N'-bis (3-hydroxy phenyl)-[1,1'-biphenyl]-4,4'-diamine and diethylene glycol bischloroformate.

Examples of polystyrenes include, for example, polystyrene, poly(bromostyrene), poly(chlorostyrene), poly(methoxystyrene), poly(methylstyrene) and the like.

Examples of polyolefins include, for example, polychloroprene, polyethylene, poly(ethylene oxide), polypropylene, polybutadiene, polyisobutylene, polyisoprene, and copolymers of ethylene, including poly(ethylene/acrylic acid), poly (ethylene/ethyl acrylate), poly(ethylene/methacrylic acid), poly(ethylene/propylene), poly(ethylene/vinyl acetate), poly (ethylene/vinyl alcohol), poly(ethylene/maleic anhydride) and the like.

Examples of polyacrylates include, for example, poly(methyl methacrylate), poly(cyclohexyl methacrylate), poly(n-butyl methacrylate), poly(sec-butyl methacrylate), poly (isobutyl methacrylate), poly(tert-butyl methacrylate), poly (n-hexyl methacrylate), poly(n-decyl methacrylate), poly (lauryl methacrylate), poly(hexadecyl methacrylate), poly (isobomyl methacrylate), poly(isopropyl methacrylate), poly (isodecyl methacrylate), poly(isooctyl methacrylate), poly (neopentyl methacrylate), poly(octyl methacrylate), poly(n-propyl methacrylate), poly(phenyl methacrylate), as well as the corresponding acrylate polymers. Other examples include, for example, poly(acrylamide), poly(acrylic acid), poly(acrylonitrile), poly(benzylacrylate), poly(benzylmethacrylate), poly(2-ethylhexyl acrylate), poly(triethylene glycol dimethacrylate). Commercially avaliable examples of these materials include acrylic and methacrylic ester polymers such as ACRYLOID™ A10 and ACRYLOID™ B72, polymerized ester derivatives of acrylic and alpha-acrylic acids both from Rohm and Haas Company, and LUCITE™

44, LUCITE™ 45 and LUCITE™ 46 polymerized butyl methacrylates from Du Pont Company.

Derivatives, in embodiments, refers to resins derived from a polymer component. The polymer component is typically incorporated into the derivative. Thus, examples of polyvinyl derivatives include, for example, poly(vinyl alcohol), poly (vinyl acetate), poly(vinyl chloride), poly(vinyl butyral), poly (vinyl fluoride), poly(vinyl pyridine), poly(vinyl pyrrolidone), poly(vinyl stearate) and the like. Commercially available polyvinyl derivatives include chlorinated rubber such as PARLON™ from Hercules Powder Company; copolymers of polyvinyl chloride and polyvinyl acetate such as Vinylite VYHH and VMCH from Bakelite Corporation, and alkyd resins such as GLYPTAL™ 2469 from General Electric Co.

Examples of polyurethanes include, for example, aliphatic and aromatic polyurethanes like NEOREZ™ 966, NEOREZ™ R-9320 and the like, manufactured by NeoResins Inc., copolymers of polyurethanes with polyethers and polycarbonates like THECOTHANE®, CARBOTHANE®, TECHOPHYLIC® manufactured by Thermadics in Wilmington, Mass. (USA), BAYDUR® and BAYFIT®, BAYFLEX® and BAYTEC® polyurethane polymers manufactured by Bayer, and the like.

Examples of polyamides include, for example, Nylon 6, Nylon 66, TACTEL™ which is a registered mark of DuPont, modified polyamides like ARLEN™ from Mitsui Chemicals and TORLON®, and the like.

Examples of polyesters include, for example, poly(ethylene terepthalate), poly(ethylene napthalate) and the like.

Examples of silicone resins include, for example, polydimethylsiloxane, DC-801, DC804, and DC-996, all manufactured by the Dow Corning Corp. and SR-82, manufactured by GE Silicones. Other examples of silicone resins include copolymers such as silicone polycarbonates, that can be cast into films from solutions in methylene chloride. Such copolymers are disclosed in U.S. Pat. No. 3,994,988. Other examples of silicone resins include siloxane modified acrylate and methacrylate copolymers such as described in U.S. Pat. Nos. 3,878,263 and 3,663,650, methacryl silanes such as COATOSIL® 1757 silane, SILQUEST® A-174NT, SILQUEST® A-178, and SILQUEST® Y-9936 and vinyl silane materials such as COATOSIL® 1706, SILQUEST® A-171, and SILQUEST® A-151 all manufactured by GE-Silicones. Also, solvent-based silicone coatings such as UVHC3000, UVHC8558, and UVHC8559, also manufactured by GE-Silicones, may be used. Aminofunctional silicones may be combined with other polymers to create polyurethanes and polyimides. Examples of aminofunctional silicones include, for example, DMS-A11, DMS-A12, DMS-A15, DMS-A21, and DMS-A32, manufactured by Gelest Inc. Silicone films can also be prepared via RTV addition cure of vinyl terminated polydimethylsiloxanes, as described by Gelect Inc.

Another example of silicone-based coating binders is a cured elastomer derived from the SYLGARD® line of silicone materials. Examples of such materials include SYLGARD® 182 SYLGARD® 184 and SYLGARD® 186, available from Dow Corning.

Examples of epoxy resins include, for example, cycloaliphatic epoxy resins and modified epoxy resins like for example UVACURE 1500 series manufactured by Radcure Inc.; bisphenol-A based epoxy resins like for example D.E.R. 661, D.E.R. 671 and D.E.R. 692H all available at Dow Corning Company. Other examples include aromatic epoxy acrylates like LAROMER™ EA81, LAROMER™ LR 8713 and LAROMER™ LR9019, and modified aromatic epoxy acrylate like LAROMER™ LR 9023, all commercially available from BASF.

Examples of commercially available photoresist polymers suitable for fabrication of channels by photolithography include, for example, KTFR from Kodak comprised of a bis-aryldiazide photosensitive cross-linking agent which absorbs in the near UV, with a polyisoprene cyclized polymer to provide the necessary film-forming and adhesion properties; dry-film photoresists like for example WB2000 and WB3000 series and MX1000, MX3000 and MX9000 series all from DuPont; multifunctional glycidyl ether derivative of bisphenol-A novolac, available from Shell Chemical and known as EPON® resin SU-8; and POWDERLINK® 1174 from Cytek Industries, Inc.

In embodiments, also included over the dimension change material is a printing portion. In embodiments, printing portion refers to a component piece designed to contact the image receiving substrate so as to transfer the marking material thereto. In embodiments, locating the printing portion over the dimension change material refers to the printing portion being above the dimension change material, and in particular forming a top most part of the materials in the hole and/or unit, although it is not necessary that the printing portion be contiguous with the dimension change material. This printing portion thus provides a top portion of the unit, or within the hole, that is capable of protruding from the hole upon the change in dimension of the dimension change material.

When the dimension change material is stimulated, the dimensional change is made to extend the dimension change material vertically toward the open, imaging surface of the layer. In embodiments, for example including for use in flexographic printing, the change in dimension of the dimension change material should be sufficient to vertically extend the top surface of the printing portion (or other top surface part of the unit) beyond the opening of the hole or unit from about 0.4 mm to about 2 mm, for example from about 0.4 mm to about 1 mm. This raised height corresponds to a height at which the raised portions are in printing capable positions. At this extended height, the portions of the member where the dimension change material has been stimulated and expanded to this height will be printed, whereas the remaining portions that have not been subjected to stimulation, and thus remain in a non-stimulated or contracted state, will not be printed. The dimension change action thus moves the printing portion further up and out of the hole/unit such that the printing portion is made to be in a printing capable position where it will be able to transfer an image to an image receiving substrate brought into contact with the imaging surface of the reimageable printing member.

Knowing the printing height to which the top surface of the unit must be extended in order to be in a printing capable position, and knowing the volume change that the dimension change material undergoes upon exposure to the stimulus, one can readily determine the amount, for example thickness, of dimension change material to include within the hole and/or unit. For example, the minimum thickness of the dimension change material to include may be determined from (length/height to raise to reach printing capable position)× (percentage of swelling in dimension change material in response to stimulus). Thus, if the printing capable position is 0.5 mm above the printing member surface, and the material swells 100% upon being stimulated, then the minimum thickness of the dimension change material to include is 0.5 mm. Further, if the printing capable position is 0.5 mm above the printing member surface, and the material swells 50% upon being stimulated, then the minimum thickness of the dimension change material to include is 1.0 mm.

If present, the printing portion may be simply placed upon the dimension change material within the unit. However, it may be desirable to adhere the printing portion to the dimension change material and/or to otherwise make the printing portion to be non-removably held or contained within the unit and/or hole.

As the printing portion, while any suitable material may be used, the material in embodiments is one that has a sufficient hardness to reliably form an image on an image receiving substrate brought into contact with the printing member.Suitable polymeric materials include solid materials, for example having a Rockwell R hardness in a range from about 10 to about 250, for example from about 50 to about 200. For example, polystyrene has a hardness of from about 104 to about 120; Kolon KOPA® KN173MS Low Friction Nylon 6 (US distributor, API-Kolon) can have a hardness as high as about 215 on the same scale. Any plastic material may be used in this regard. Examples include thermoplastics like polyethylene, polypropylene, nylon, polycarbonate, thermosseting polymers such as phenol formaldehyde, urea formaldehyde, polyesters, melamine formaldehyde and the like. Additional examples of polymers include polystyrenes, polysulfones, polyethersulfones, polyarylsulfones, polyarylethers, polyolefins, polyacrylates, polyvinyl derivatives, cellulose derivatives, polyurethanes, polyamides, polyimides, polyesters, silicone resins, and epoxy resins, melamine and the like. Copolymer materials such as polystyrene-acrylonitrile, polyethylene-acrylate, vinylidenechloride-vinylchloride, vinylacetate-vinylidene chloride, and styrene-alkyd resins may also be used. The copolymers may be block, random, or alternating copolymers. See the above discussion of further examples of the foregoing materials. Additionally, reinforced polymers with particles such as aluminum or carbon black, or with fibers made of metals, ceramics or glasses, may be advantageous because of their increased hardness. Of course, a material that does not repel marking materials placed thereon is also desirable.

Figure 2:
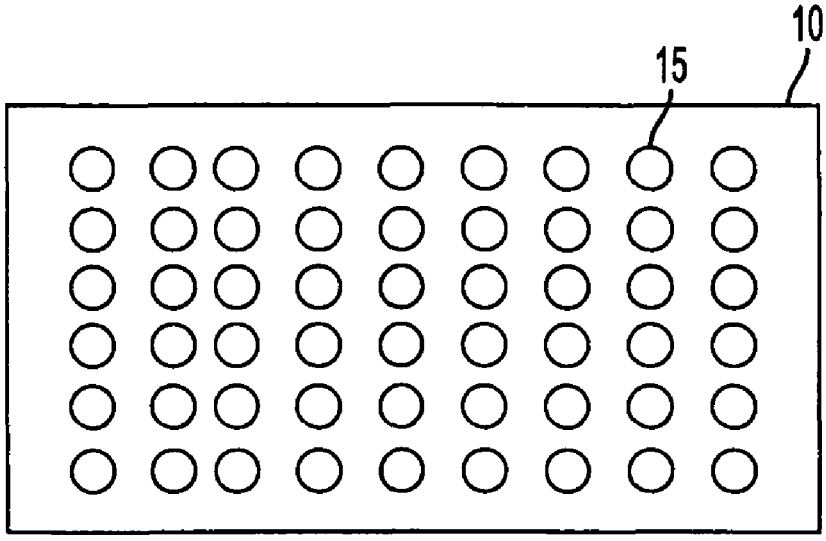
FIG. 2 illustrates a vertically expandable unit of the reimageable printing member.

The Figures illustrate embodiments described herein. FIG. 2 illustrates an example layer of the reimageable printing member having a multiplicity of holes therein. The reimageable printing member may include a layer 10 having a multiplicity of holes 15 such as channels or openings. FIG. 2 illustrates a view of the top, or imaging, surface of the printing member.

FIG. 1 illustrates a vertically expandable unit, specifically a micropiston, of the reimageable printing member. The micropiston as shown includes stimulating portions 25, in this case electrodes, surrounding dimension change material 30. A printing portion 35 is located over and/or upon the dimension change material 30. As can be seen in FIG. 1, the printing portion 35 can be made to extend or retract along vertical direction 21 via response of the dimension change material to the stimulus applied or removed by the stimulating portion 25.

Figure 3:
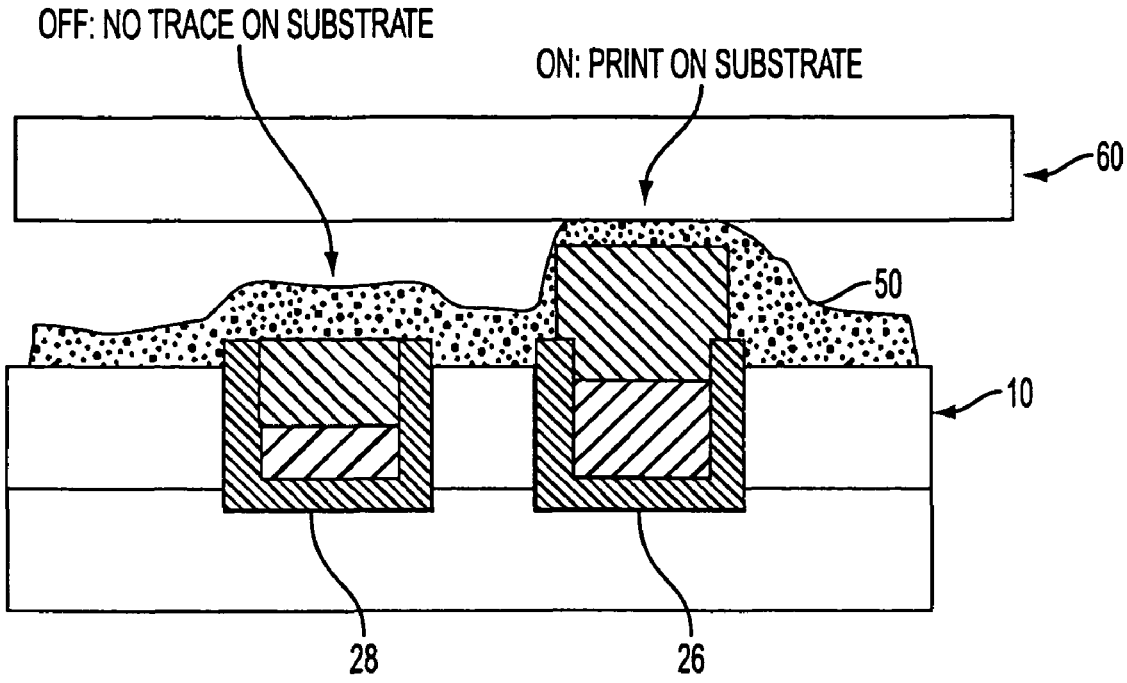
FIG. 3 illustrates a method of forming an image using the reimageable printing member.

FIG. 3 illustrates a method of forming an image using the reimageable printing member. Use of the units in a reimageable member to form an image on an image receiving substrate will be explained with reference to FIG. 3.

Upon application of the stimulus to which the dimension change material responds, the dimension change material expands, for example swells. Due to the opening on the imaging side of the reimageable printing member and the constraints on the other sides of the unit, the swelling is controlled to extend the dimension change material vertically toward the opening. Thus, in the swollen state or ON state, the dimension change material pushes up the printing portion or piston cap. In the contracted state, i.e., the OFF state, the dimension change material remains lowered within the unit. An image is thus created by selectively swelling the dimension change material in those ones of the units corresponding to portions where the image is to be formed on an image receiving substrate. This creates a raised image portion at such selected locations, the raised portions being made of the pistons (pixels) that are in the ON state. This image is transferred to an image receiving substrate 60 with a marking material 50 such as toner or ink applied to the imaging surface of the reimageable printing member. As with a standard flexographic printing member, only the portions where the piston is raised is the marking material transferred onto the image receiving substrate.

In FIG. 3, the unit 26 on the right side is extended into a printing capable ON position as a result of the application of the appropriate stimulus to the dimension change material in the unit. Only pixels in the ON state will transfer an image onto the image receiving substrate brought into contact with the imaging surface of the printing member. The unit 28 on the left is contracted, or is in the OFF state, and thus does not touch the image receiving substrate 60. As discussed extensively above, each pixel can be independently and reversibly switched to the ON or OFF state, to create new images.

After contacting the member with an image receiving substrate, creation of a further same image can be done with the member, for example by providing additional marking material to the surface of the member. In addition, a different image may be formed using the same member by switching other pixels selectively to the ON or OFF position as discussed above. Again, it may be desired to provide additional marking material to the imaging surface of the member before conducting additional printing thereof. The cycle of forming images with the member may be repeated many times.

During or following transfer to the image receiving substrate, a drum or plate may be used. For example, to ensure high quality of printing, a top drum or plate may be used for pressing the substrate against the member when the image is transferred onto the substrate. The top drum or plate may be heated in order to fix the image onto the substrate. This may be useful in the case when toner particles are being used, since toner needs to be fused in order to be permanently fixed on the substrate.

In forming an image, the reimageable printing member may be used to form an image on an intermediate transfer member as the image receiving substrate, which image is then subsequently transferred to a final substrate to be printed. Otherwise, the reimageable printing member may be used to directly transfer the image to the image receiving substrate, which image receiving substrate is the substrate to be printed.

Marking materials that may be used herein include any suitable colorant material, including inks and dry toners. The marking materials may have any desired color, including the conventional colors of black, magenta, cyan and yellow. The marking materials may have any suitable composition, and any toner or ink composition may be used. As but a few examples of colorants for the marking material, mention may be made of dyes and pigments, such as carbon black (for example, REGAL 330™), magnetites, phthalocyanines, HELIOGEN BLUE L6900, D6840, D7080, D7020, PYLAM OIL BLUE, PYLAM OIL YELLOW, and PIGMENT BLUE 1, all available from Paul Uhlich & Co., PIGMENT VIOLET 1, PIGMENT RED 48, LEMON CHROME YELLOW DCC 1026, E.D. TOLUIDINE RED, and BON RED C, all available from Dominion Color Co., NOVAPERM YELLOW FGL and HOSTAPERM PINK E, available from Hoechst, CINQUASIA MAGENTA, available from E.I. DuPont de Nemours & Company, 2,9-dimethyl-substituted quinacridone and anthraquinone dyes identified in the Color Index as CI 60710, CI Dispersed Red 15, diazo dyes identified in the Color Index as CI 26050, CI Solvent Red 19, copper tetra (octadecyl sulfonamido)phthalocyanine, x-copper phthalocyanine pigment listed in the Color Index as CI 74160, CI Pigment Blue, Anthrathrene Blue, identified in the Color Index as CI 69810, Special Blue X-2137, diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, Permanent Yellow FGL, Pigment Yellow 74, B 15:3 cyan pigment dispersion, commercially available from Sun Chemicals, Magenta Red 81:3 pigment dispersion, commercially available from Sun Chemicals, Yellow 180 pigment dispersion, commercially available from Sun Chemicals, colored magnetites, such as mixtures of MAPICO BLACK™ and cyan components, and the like, as well as mixtures thereof. Other commercial sources of pigments available as aqueous pigment dispersion from either Sun Chemical or Ciba include Pigment Yellow 17, Pigment Yellow 14, Pigment Yellow 93, Pigment Yellow 74, Pigment Violet 23, Pigment Violet 1, Pigment Green 7, Pigment Orange 36, Pigment Orange 21, Pigment Orange 16, Pigment Red 185, Pigment Red 122, Pigment Red 81:3, Pigment Blue 15:3, and Pigment Blue 61, and other pigments that enable reproduction of the maximum Pantone color space. Mixtures of colorants can also be employed.

The above-described system can be extended to the printing of multicolor images on the desired substrate. Such may be achieved, for example, by passing of the substrate to be printed through multiple reimageable members, each of the reimageable members containing marking materials of a single color that is different from colors applied by the other reimageable members. Alternatively, multicolor printing may be obtained by using a single reimageable member that is used to successively provide the differently colored portions of the image. In this embodiment, it is obviously desirable to clean the imaging surface of the member of the previously applied colored marking material prior to using the member to apply the next colored marking material. In this regard, any known cleaning station or cleaning device may be used.

Although a main use of the reimageable member described herein is in printing images on substrates via flexography, for example in which the member is carried on a belt and then contacted with the image receiving substrate at an image transfer station, the use of the reimageable member is not limited solely to flexographic applications. The reimageable member may be used in any printing operation where printing is done using a printing member, for example printing using direct marking engines. In such devices, the member is first made to bear the desired image, the marking material is supplied thereto, and printing to one or more image receiving substrates is effected. The imaging surface of the member may then be cleaned, and the process repeated. The reimageable printing member may also be used in a similar manner in offset systems.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A reimageable printing member comprising:

a plurality of stimulating units that provide a stimulus, a multiplicity of vertically expandable units, wherein each of the vertically expandable units includes a dimension change material having an original dimension, wherein each of the vertically expandable units is provided with a stimulating unit of the plurality of stimulating units, the plurality of stimulating units being separate from the dimension change material, wherein each of the vertically expandable units are individually addressable by the stimulus provided by its respective stimulating unit, wherein the provided stimulus initiates a change in dimension in the material, wherein the dimension change material is capable of increasing in volume from about 10% to about 250% of the original dimension in response to the provided stimulus, and wherein the dimension change material is able to revert to substantially the original dimension upon removal of the stimulus.

2. The reimageable printing member according to claim 1, wherein the vertically expandable units are housed in holes in a layer of the reimageable printing member.

3. The reimageable printing member according to claim 2, wherein the holes include a chamber containing the dimension change material.

4. The reimageable printing member according to claim 2, wherein the dimension change material is included within a capsule, and the capsule is placed within the hole.

5. The reimageable printing member according to claim 2, wherein the vertically expandable units further include a printing portion over the dimension change material.

6. The reimageable printing member according to claim 5, wherein the holes are open on one side of the layer such that the printing portion is free to protrude from the hole.

7. The reimageable printing member according to claim 1, wherein each of the vertically expandable units represents a pixel of an image to be formed.

8. The reimageable printing member according to claim 1, wherein the plurality of the stimulating units are selected from the group consisting of an electrode, a light emitter, a heat emitter and combinations thereof.

9. The reimageable printing member according to claim 1, wherein the stimulus is selected from the group consisting of an electric field, a magnetic field, light, heat and combinations thereof.

10. The reimageable printing member according to claim 1, wherein the dimension change material is a material that changes dimension at least in response to application of an electric field.

11. The reimageable printing member according to claim 10, wherein the material is selected from dielectric silicone, fluoroelastomers, acrylic elastomers, halogenated elastomers, polymers comprising silicone and acrylic moieties, copolymers thereof, thermotropic liquid crystalline elastomers, carbon nanotube actuators, polymer gels, a cross-linked poly(2-acrylamido-2-methyl propane) sulphonic acid and a cross-linked sodium salt of poly(acrylic acid).

12. The reimageable printing member according to claim 1, wherein the dimension change material is a material that changes dimension at least in response to application of light.

13. The reimageable printing member according to claim 12, wherein the material is selected from among polymer films mixed with low molecular weight photochromic compounds, polyamide and polyamide with backbone azobenzene groups, polyquinoline with backbone stilbene groups, polytetrahydrofuran with backbone viologen groups, polyalkylacrylates with azobenzene photochromic groups, polymer gels incorporating photochromic molecules, polymers containing photoresponsive cinnamic groups or cinnamylidene acetic acid, and combinations thereof.

14. The reimageable printing member according to claim 1, wherein the dimension change material is a material that changes dimension at least in response to application of heat.

15. The reimageable printing member according to claim 14, wherein the material is selected from among hydrogels, grafted N-isopropylacrylamide on ethylene-vinyl alcohol polymers, polyethylene films in water, crosslinked copolymers containing stearyl acrylate and methyl acrylate in water, and copolymers made from hydroxyethylacrylate and hydroxypropylacrylate in water.

16. The reimageable printing member according to claim 1, wherein the dimension change material is a material that changes dimension at least in response to application of a magnetic field.

17. The reimageable printing member according to claim 16, wherein the material is a lyotropic liquid crystal.

18. The reimageable printing member according to claim 1, wherein the dimension change material responds to stimulus with an electrochemically based dimension change, and comprises conductive polymers with a solid electrolyte and ionic polymer-metal composite, doped polypyrrole, polyanilines, polythiophenes or polyferrocenyldimethylsilanes.

19. The reimageable printing member according to claim 1, wherein each of the vertically expandable units has a diameter or width of about 1 μm to about 200 μm, and an average spacing between units is from about 0.1 μm to about 100 μm.

20. A direct marking engine including the reimageable printing member of claim 1.

21. A flexographic printing system including the reimageable printing member of claim 1.

22. The flexographic printing system according to claim 21, wherein the system includes a belt carrying the member thereon.

* * * * *